United States Patent [19]

Woodhead

[11] 4,243,145

[45] Jan. 6, 1981

[54] CASSETTE MODULES AND DISPLAYS FOR TUBULAR ARTICLES

[75] Inventor: Robert G. Woodhead, Ringoes, N.J.

[73] Assignee: The American Thread Company, Stamford, Conn.

[21] Appl. No.: 913,955

[22] Filed: Jun. 9, 1978

[51] Int. Cl.[3] ..... A47K 1/08; A47K 1/14; B65D 83/04

[52] U.S. Cl. ..... 211/49 D; 211/71; 211/189; 221/131; 221/197; 242/139; 312/45; 312/72; 312/198; 312/234.4

[58] Field of Search ..... 211/49 D, 55, 71, 81, 211/85, 169, 189, 201, 204, 128, 131; 312/35, 42, 45, 49, 72, 73, 128, 198, 234.1, 234.4; 221/92, 131, 197, 311; 242/134, 137, 139; 220/23.4; 206/44, 12, 504, 558

[56] References Cited

U.S. PATENT DOCUMENTS

| | | | |
|---|---|---|---|
| 667,081 | 1/1901 | Genter | 221/92 |
| 1,418,324 | 6/1922 | O'Connor | 312/234.4 X |
| 1,931,403 | 10/1933 | Connor | 211/49 D X |
| 2,492,912 | 12/1949 | Womak | 312/45 |
| 3,010,606 | 11/1961 | Heselov | 211/49 D X |
| 3,078,016 | 2/1963 | Judy | 220/23.4 |
| 3,152,697 | 10/1964 | Berman et al. | 211/49 D |
| 3,191,776 | 6/1965 | Tokash | 211/128 X |
| 3,194,620 | 7/1965 | Sauer | 211/49 D X |
| 3,258,128 | 6/1966 | McPherson | 211/133 |
| 3,298,763 | 1/1967 | Domenico | 211/49 D X |
| 3,351,209 | 11/1967 | Kofoed et al. | 211/49 D |
| 3,662,898 | 5/1972 | Baxendale | 211/49 D |
| 3,776,419 | 12/1973 | Zinkgraf | 221/197 |
| 4,015,885 | 4/1977 | Baggaley | 211/49 D X |
| 4,018,360 | 4/1977 | Strauss | 242/137 X |
| 4,123,125 | 10/1978 | Andry | 312/42 X |

FOREIGN PATENT DOCUMENTS

| | | | |
|---|---|---|---|
| 2322691 | 11/1974 | Fed. Rep. of Germany | 312/234.1 |
| 447914 | 11/1912 | France | 312/45 |
| 1274556 | 9/1961 | France | 211/43 |
| 1386781 | 12/1964 | France | 221/311 |
| 1505594 | 6/1967 | France | 211/204 |
| 245382 | 1/1926 | United Kingdom | 312/45 |
| 627398 | 8/1949 | United Kingdom | 211/43 |

*Primary Examiner*—Thomas J. Holko
*Attorney, Agent, or Firm*—Kenyon & Kenyon

[57] ABSTRACT

Cassette modules and cassette displays for merchandizing tubular articles such as spools of thread are disclosed. In the preferred embodiments, the cassette modules are formed from module halves and are juxtaposed to form a cassette display, each cassette module comprising a plurality of chambers superposed in a column for housing the articles. In one disclosed embodiment, a frame is provided in which the cassette modules are mounted and removable from to form a cassette display. In that embodiment, each cassette module is pivotable about its upper end to facilitate mounting and also to facilitate loading of the articles into the chambers of the cassette modules. The height of the chambers of an individual cassette module and/or the chambers of cassette modules may vary to accommodate articles of different tubular sizes and the cassette modules may have different widths to accommodate articles of different length. Cassette modules in a cassette display may also differ from each other in their make-up of chambers. A cassette display may thereby be assembled to accommodate, if desired, articles of different diameters and lengths by the proper choice of cassette modules. The cassette modules and cassette displays according to the invention are utilizable on counters, free standing floor displays, pegboard walls, gondola frames, build-ups and fabric display tables.

27 Claims, 10 Drawing Figures

CASSETTE MODULES AND DISPLAYS FOR TUBULAR ARTICLES

BACKGROUND OF THE INVENTION

The present invention relates to units for housing tubular articles and more particularly to cassette modules and cassette displays for merchandising tubular articles such as spools of thread.

Space in merchandising areas is usually limited to shelving, counters, displays, etc. and must be carefully laid out to maximize space utilization while presenting an esthetically pleasing appearance. This is particularly true where the overall sizes of individual units of merchandise vary and characteristics of the merchandise itself, such as color and composition vary. It is highly desirable to display at least one of each of the different units and at the same time provide a multiplicity of each which are easily removable from the display or shelf.

In the merchandising of thread, which comes in a multiplicity of thread diameters, strengths, materials and colors, and on spools of many different sizes, it is necessary to display at least one of each of the units being sold, i.e., one spool of thread should be displayed for each spool size, each thread color, each thread diameter, each thread material, etc., while at the same time providing a multiplicity of each for easy removal and sale. Ordinarily this takes up a great deal of shelf and/or display space utilizing existing or conventional merchandising technology.

In accordance with the present invention, cassette modules and cassette displays are provided in which tubular articles of various sizes and characteristics may be compactly and esthetically merchandised.

SUMMARY OF THE INVENTION

According to the invention, modular cassette units or cassette modules and cassette displays are provided for merchandising tubular articles, particularly spools of thread. Each cassette module includes a plurality of adjacent chambers for housing the articles. The cassette modules may be juxtaposed to form a horizontal cassette display or superposed to form a vertical cassette display. The depth and/or height of each cassette module is identical for each cassette display or module group thereof. This permits the cassette modules to be superposed or juxtaposed. The cassette modules according to one aspect of the invention include means for removably assembling the cassette modules into a cassette display or a display of cassettes.

In the preferred embodiments, the chambers of each cassette module are superposed and are of equal width or equal to a tubular size. The cassette modules are juxtaposed to form a cassette display. A supporting surface in each chamber for the articles is inclined downwardly toward the front of the cassette module and a surface for each of the chambers intersecting the supporting surface is provided proximate the front of the cassette module for retaining the tubular articles thereat. An opening to each chamber at the front of the cassette module and extending along the sides of the cassette module is provided to permit removal of the tubular articles from the chambers. The tubular articles are also loaded into the chambers by means of the openings and means defining an entrance to the chambers are provided to facilitate loading and removal of articles through the openings. Another opening to each chamber is preferably provided at the rear of the cassette module for loading. Telescoping support rods are provided to retain the cassette modules in a cassette display. In one embodiment, the cassette modules are mounted in a frame to form a cassette display, the cassette modules being pivotable in the frame for easy removal and mounting and for easy replenishing of stock. The cassette modules and cassette displays according to the invention are utilizable on counters, free standing floor displays, pegboard walls, gondola frames, build-ups and fabric display tables.

The cassette modules according to the invention are compact, individual units, easily assembled, adaptable to housing articles of varying sizes and, if desired, they may be used on counters and directly on floors thereby not occupying otherwise unavailable space. The inherent design of the cassette modules, which relate to the physical merchandising of an SKU (stock keeping unit) and is multiples, plus the modular aspect of the cassette display, permits a greater number of SKU's and their multiples to be displayed in less square footage of space than is attainable by present thread display techniques.

These and other aspects of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references apply to like parts and in which.

DESCRIPTION OF THE PREFERRED EMBODIMENTS

Figure 1:
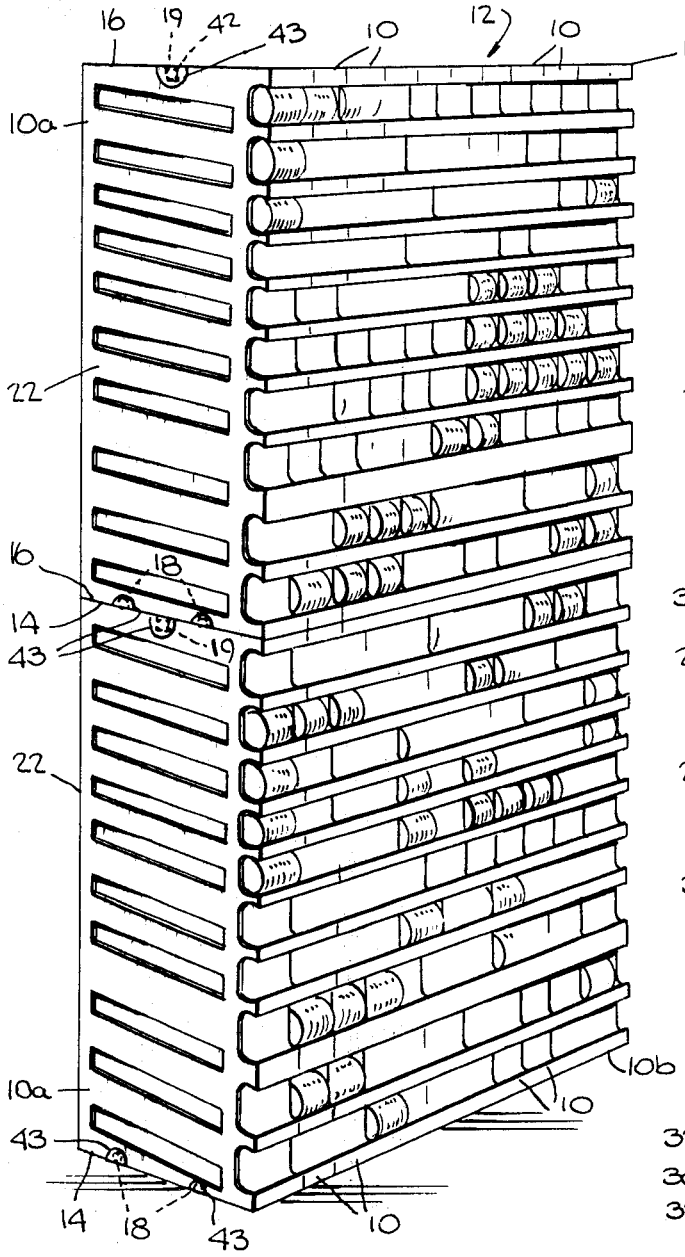
FIG. 1 is a perspective view of a cassette display according to the invention showing eleven cassette modules according to the invention, each of equal horizontal cross-sectional dimensions, stacked two high to form the cassette display.

In FIG. 1 are shown cassette modules 10 according to the invention which are juxtaposed and vertically stacked to form a cassette display 12. The cassette modules are utilized in the merchandising, display and sale of spools of thread. Each cassette module 10 includes a planar base surface 14 and a planar top surface 16. Thus, cassette modules 10 may be stacked, used individually, or juxtaposed to form a cassette display 12 that may be placed on a counter or other surface. Adjustable rods 18,19 are used to retain the cassette modules in a cassette display.

Cassette module 10 (FIG. 2) includes a plurality of superposed spool chambers or magazines 20, ten chambers being shown for purposes of illustration. Each chamber of cassette module 10 is of equal width, the cassette module having overall, generally planar sides 22, whereby the cassette modules may be juxtaposed as shown in FIG. 1. The overall height of the cassette modules is also equal thereby providing the planar tops and base surfaces of the cassette display 12. Each of the chambers 20 of the cassette module 10 shown in FIG. 2 accommodates spools 24 of generally equal size.

Figure 3:
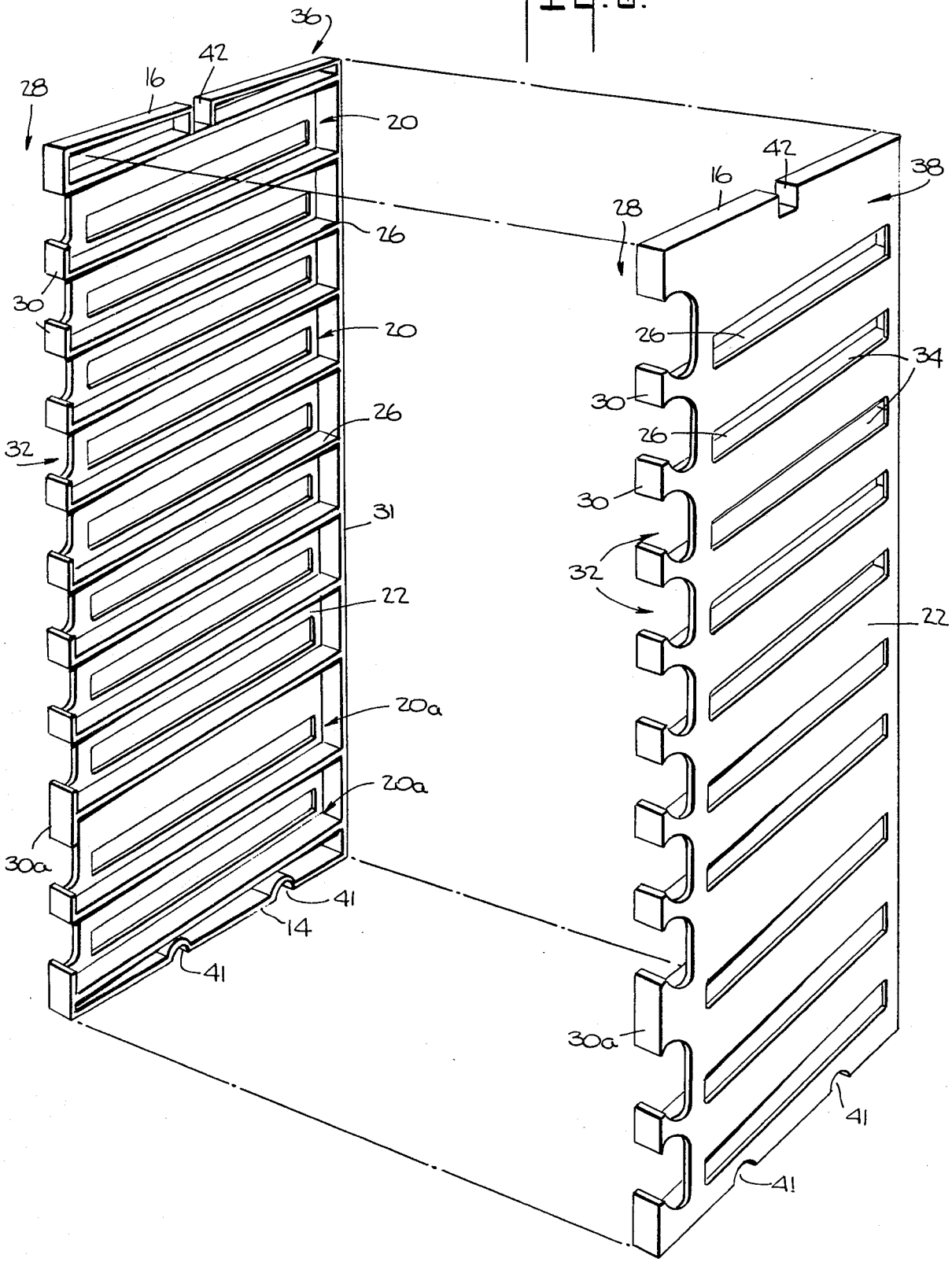
FIG. 3 is an exploded perspective view of the cassette module of FIG. 2 showing the left and right mirror image module halves which are joined to form the cassette module.

Chambers 20 are formed by the sides of the cassette module and by partitions 26 inclined downwardly toward the front 28 of the cassette module. Intersecting and projecting generally vertically past each partition at the front of the cassette module are walls 30. The tops of the partitions are planar-surfaced to form the bottom of the chamber on which the spools are supported. The bottoms of the partitions form the tops of the chambers and the sides 22 of the cassette module form the sides of the chambers. The chambers are closed by the rear 31 of the cassette module. Openings 32 for displaying and introducing and removing spools to and from the chambers extend along the front of the cassette module between superposed walls 30 of adjacent chambers and along the sides 22 of the cassette module, the sides being cut out adjacent the front of the cassette module. The distance between adjacent walls 30 is selected to permit easy passage therethrough of thread spools of a predetermined diameter or range of diameters and to also provide a large area through which the spools may easily be viewed. Similarly, the dimensions of the cutouts on the sides of the cassette module forming the opening are selected and contoured to permit easy loading and removal of spools while at the same time providing a large area for viewing the first spool in the chamber. The sides 22 of the cassette module have slots 34 extending therein from proximate the rear of the cassette module to proximate the front of the cassette module and which are positioned in the chambers between the partitions (FIG. 3). The height of the slots 34 is smaller than the diameter of the spools intended to be housed in the chambers. The slots are provided to reduce the material required in the fabrication of the cassette module, to reduce cassette module weight and to permit, to some extent, particularly for the end cassette modules 10*a*, 10*b* (FIG. 1), a view of the spools housed in the chambers.

Figure 2:
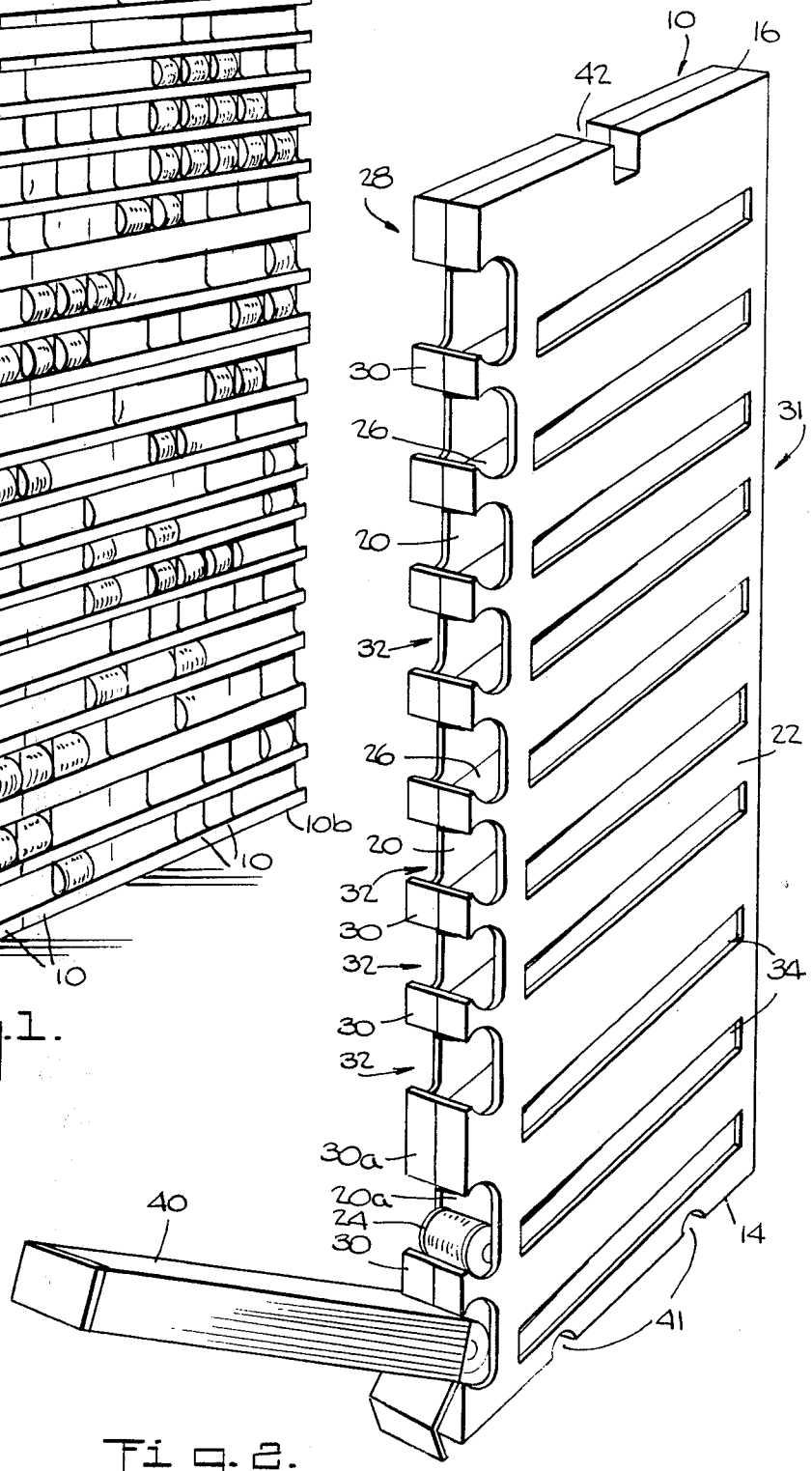
FIG. 2 is a perspective view of one of the cassette modules comprising the cassette display shown in FIG. 1, and showing spools of thread being loaded from a carton into the cassette module.

One or more of the front vertical walls 30 may be of different height to visually separate parts of the cassette module 10. As shown in FIGS. 2 and 3, wall 30*a* is vertically longer than the other walls 30. Thus, the chambers below the walls 30*a* are visually separated from those above it and spools with threads having different characteristics may be visually separated. For example, threads of larger diameter or higher strength may be placed in lower chambers 20*a* while other threads are placed in the upper chambers 20.

According to the invention, the cassette module shown in FIG. 2 is formed by the module halves or sub-assemblies 36, 38 shown in FIG. 3. As there shown, each module half includes a side 22, a half of each of the superposed chambers and half of the top and bottom of the cassette module. The module halves are mirror images of each other and each is made of plastic by injection molding. Thus, cassette displays 12 as shown in FIG. 1 can be fabricated using a few as two complete sets of dies, one set for each tubular spool size. The module halves are joined along their interior by, for example, adhesives and/or heat treatment or built-in locking devices to form the individual cassette modules. Molding and joining techniques used to fabricate the cassette modules are known in the art. Cassette modules may also be fabricated of other modular sections or sub-assemblies.

Figure 7:
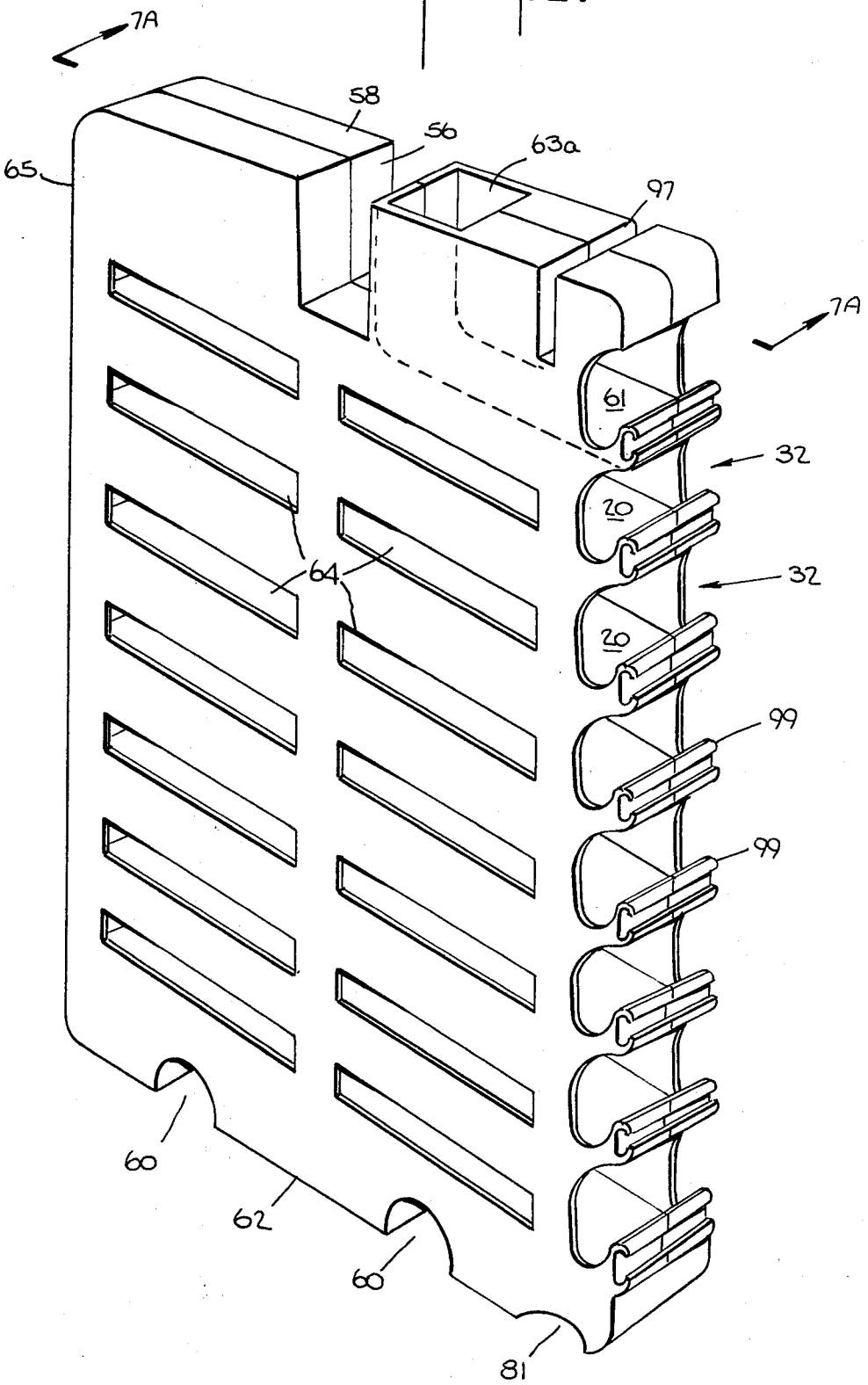
FIG. 7 is a perspective view of a typical cassette module of the type shown in FIGS. 5 and 6.
Figure 7A:
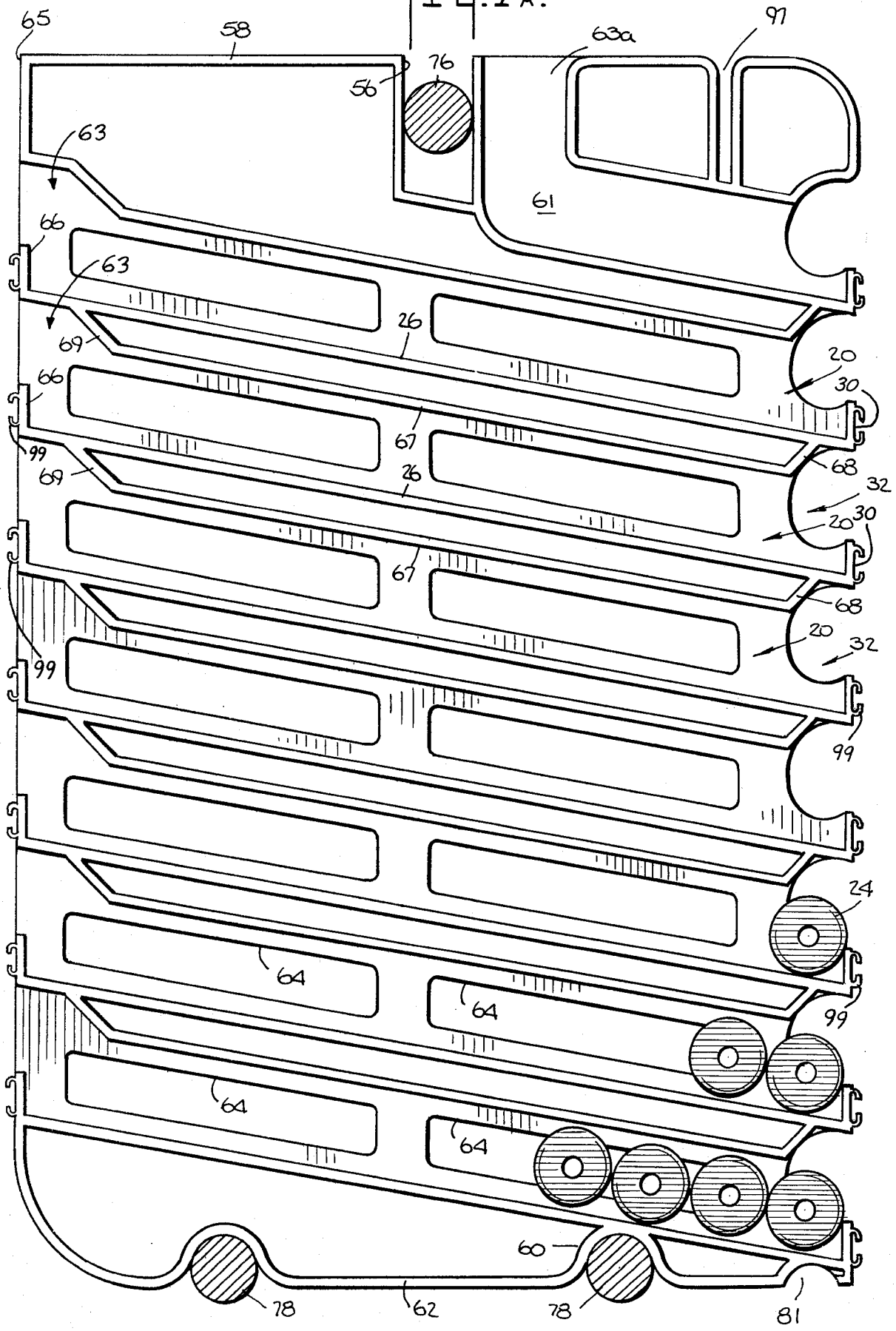
FIG. 7A is a vertical cross-section view of the cassette module shown in FIG. 7 taken along lines 7A—7A thereof.

As mentioned, the size and contour of openings 32 permit easy loading of thread spools into the chambers. FIG. 2 shows the lowermost chamber being loaded from a carton 40. Cassette modules 10 and the cassette display 12 may be easily pivoted to incline the chambers rearwardly so that the spools will roll from the cartons into and along the chambers until the spools are stopped at the rear of the chambers. Additionally, loading could be accomplished through the rear of the cassette modules by openings providing thereat. A cassette module with openings in the rear is shown in FIGS. 7 and 7A.

The cassette modules include two radiused openings 41 on the bottom for support rods 18 and one slot 42 for a stabilizer rod 19 on the top, the openings and slot extending the width of the cassette modules. Each of the rods 18, 19 is formed from two telescoping sections which are adjusted and locked together by means of set screws. The rectangular rod slot 42 on the top is sufficiently deep to enable removal of the cassette module from the cassette display without disturbing adjacent cassette modules. Connected at the ends of each of the rods is an enlarged end portion or cap 43 which is larger than the diameter of the radiused openings 41 and the width of slots 42.

The chambers 20 and all of the cassette modules 10 shown in FIG. 1 are identical. Additionally, the chambers shown in FIGS. 1–3 are also of identical size with the exception of chamber 20*a* which is larger than the others but which accommodates spools of the same diameter due to the identical size openings for all of the chambers. However, cassette modules may be fabricated in which the chambers and openings of individual cassette modules and of different cassette modules vary to accommodate spools of different diameters. Also, cassette modules may be fabricated having chambers of different length. It is also contemplated that the module halves 36,38 may be juxtaposed and jointed along their exterior by, for example, adhesives and/or heat treatment or built-in locking devices, as are joined the module halves, to form individual cassettes, to form the displays.

Figure 4:
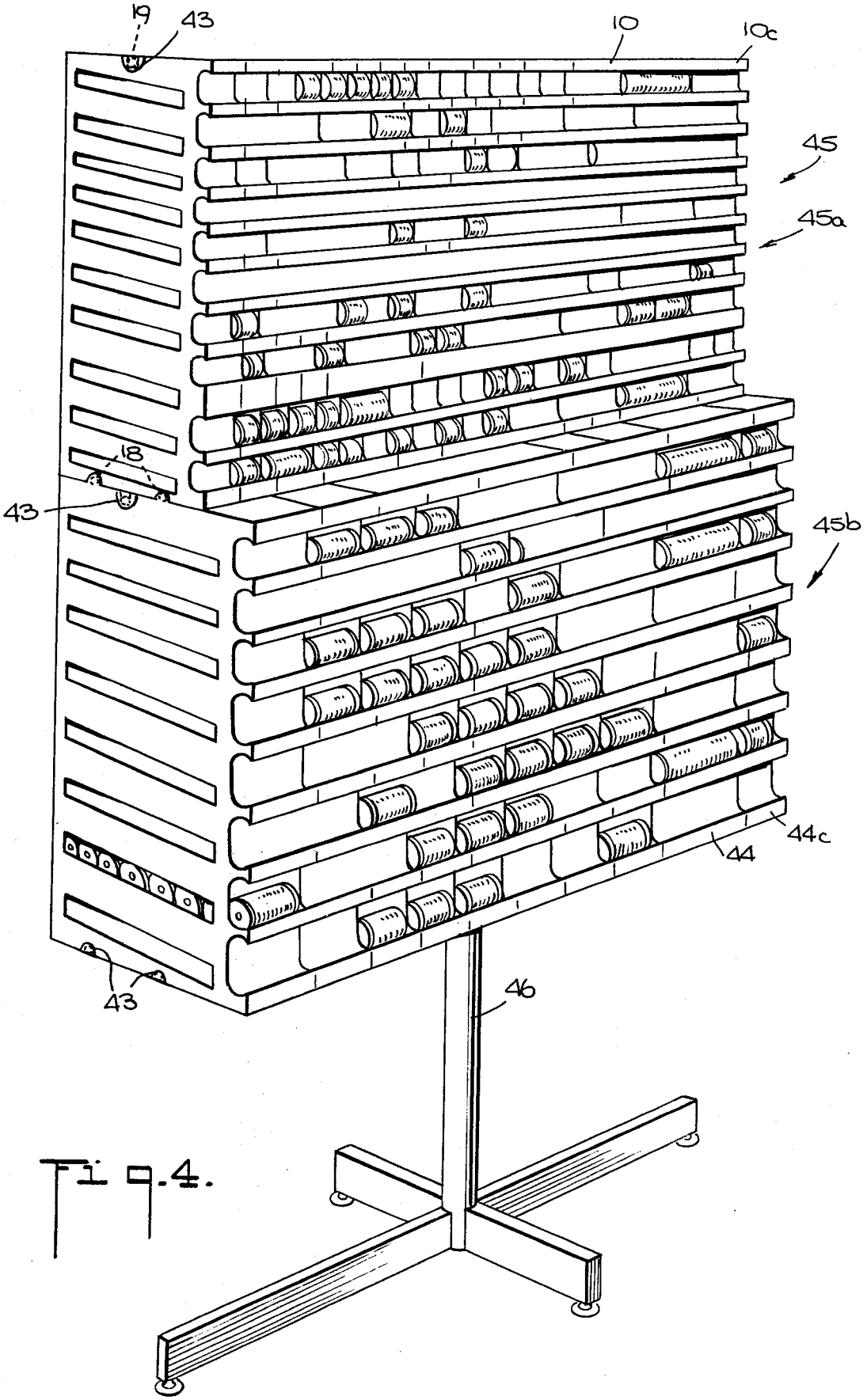
FIG. 4 is a perspective view of another cassette display showing cassette modules similar to those of FIG. 1 but of different horizontal cross-sectional dimensions, the cassette display consisting of 22 cassette modules on top stacked on 11 cassette modules below with the entire display being mounted on a pedestal floor stand.

Referring to FIG. 4, cassette modules are shown having chambers of varying size. For example, the chambers of cassette modules 10 and 44 are of different length as well as of different height; and cassette modules 10 and 10c, and 44 and 44c have chambers of different width. Cassette module groups 45a, 45b include cassette modules of different size as well as chambers of varying size and cassette display 45 is therefore capable of merchandising several different size spools of thread. A stand 46 is provided for cassette display 45 so that it can be placed on available floor space. Thus, shelving need not be provided for the spools, and existing shelving can be used for other merchandise. Alternatively, cassette display 45 can be provided without the stand for use on counters as is cassette display 12 of FIG. 1.

Referring now to FIGS. 5–7A, cassette modules 50 are mounted in display frame 52 to form an engaged and disengaged cassette display 54. Cassette modules 50 are similar to the cassette modules 10 and 44 shown in FIGS. 1–4 and include a slotted opening 56 at the top 58 and spaced, U-shaped openings 60 at the bottom 62 of the cassette module by means of which the cassette modules are mounted in the display frame. Slots 64 are not continuous in cassette modules 50 (FIGS. 7 and 7A) to provide greater strength in the central part of the sides of the cassette module below top opening 56. Cassette modules 50 (FIGS. 7 and 7A) may additionally include another chamber 61 extending adjacent the top 58 of the module and terminating adjacent slotted opening 56. An opening 63a is provided adjacent opening 56 in the top of the module for loading spools into chamber 61. Cassette modules 50 also include openings 63 in the rear 65 of the module for loading spools into chambers 20. Rear wall 66 provides a stop for spools loaded through front opening 32. An additional partition 67 (FIG. 7A) is provided for each chamber of cassette module 50, forming the top of the chamber. The central part of partition 67 is parallel to partition 26 (except for the uppermost partition) and the ends 68, 69 of partition 67 are inclined and extend towards and terminate at partition 26. Partition end 68 is disposed in front openings 32 and provides a downwardly and rearwardly inclined surface which facilitates loading of spools through the front openings. Partition end 69 is disposed in rear openings 63 and provides a downwardly and forwardly inclined surface which facilitates loading of spools through the rear openings. Partition ends 68 and 69 together with the part of the bottom of partition 26 adjacent the front and rear, respectively, of the cassette module form entrances to the front and rear, respectively, of the chambers. Cassette modules 50 may be fabricated as described for cassette modules 10. The uppermost and lowermost chambers of cassette modules 50, and also of cassette modules 10, are spaced from the top and bottom of the cassette module to accommodate the inclination of the chambers, and to accommodate the openings in the top and bottom.

Figure 5:
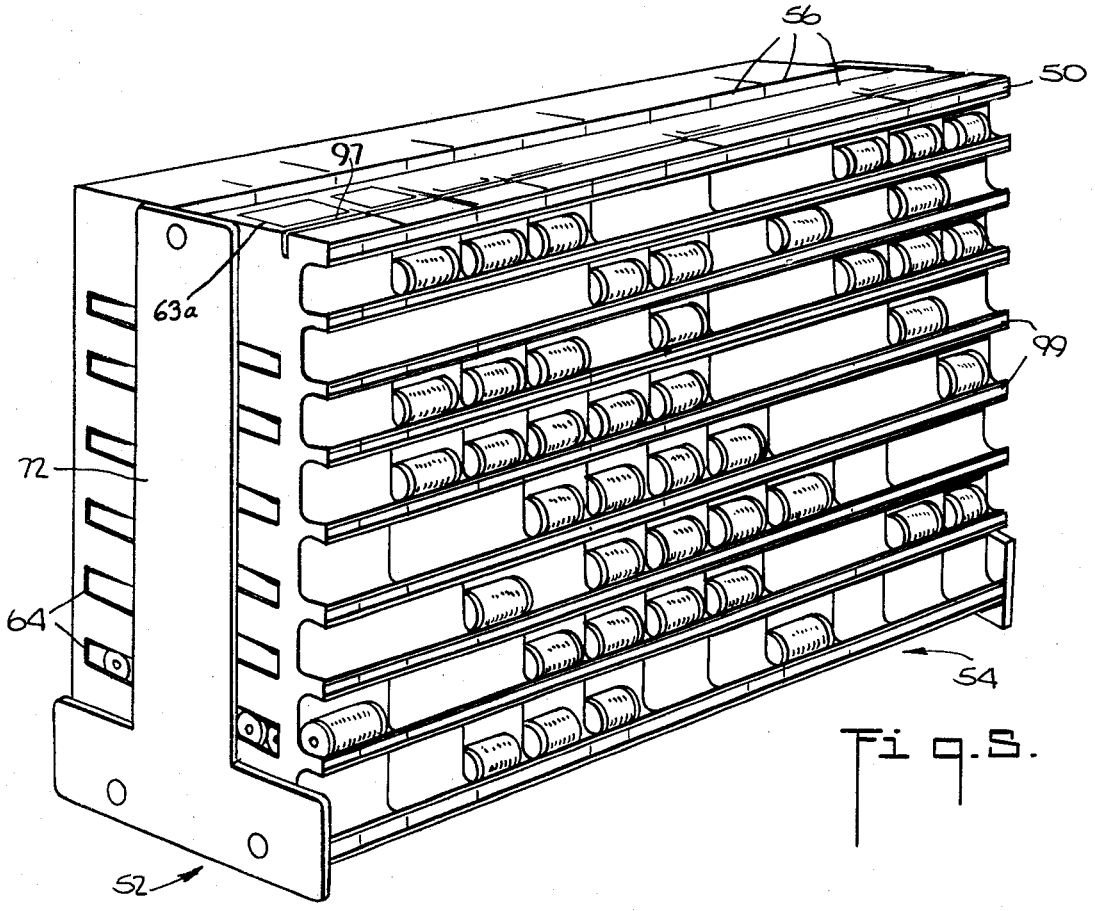
FIG. 5 is a perspective view of another embodiment of a cassette display according to the invention in which 11 cassette modules are individually and pivotably mounted in a frame.
Figure 6:
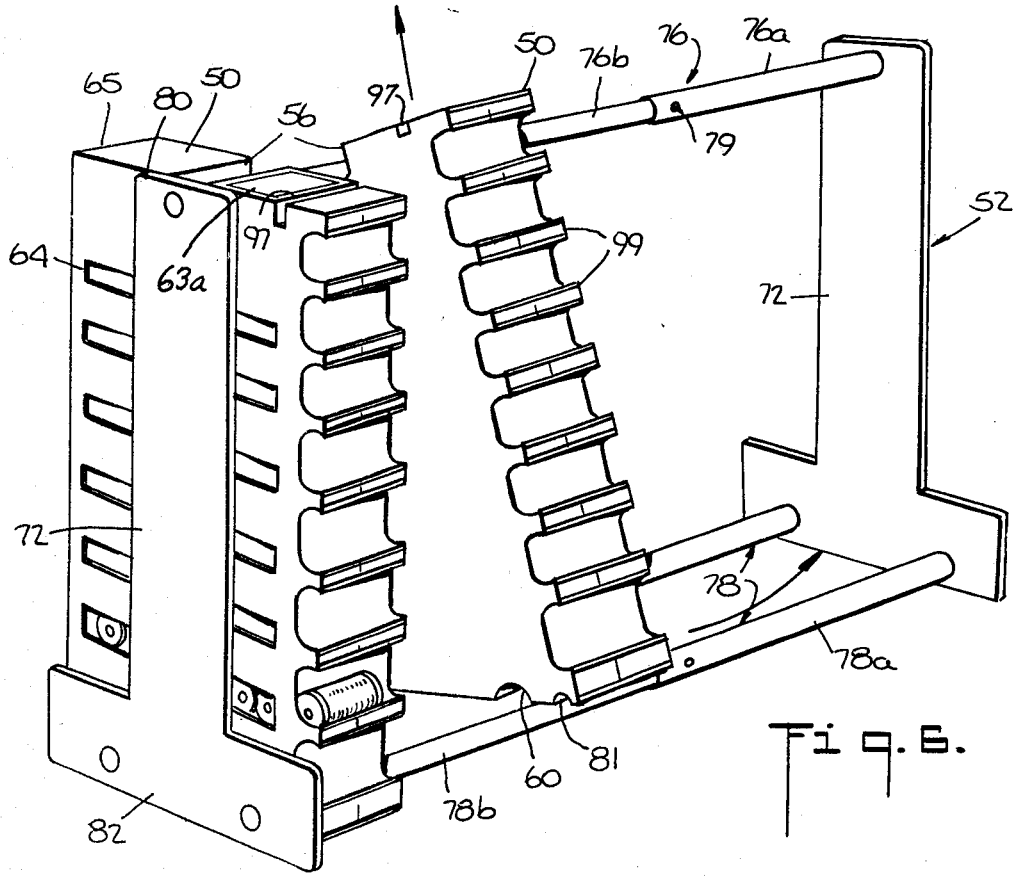
FIG. 6 is a perspective view of the frame and two cassette modules of the cassette display shown in FIG. 5, one of the cassette modules being in a pivoted position for loading or replenishing stock.

Display frame 52 comprises spaced side plates 72 connected by upper rod 76 and spaced lower rods 78. The plates are in the shape of an inverted T and when connected by the rods form the rigid self-standing display frame 52 (FIGS. 5, 6). The plates may be rectangular (100, FIG. 9) or have other shapes. The top 80 (FIG. 6) of the inverted T is connected to the upper rod 76 and the base 82 of the inverted T is connected to the lower rods 78. The lower rods support the cassette modules and the upper rod stabilizes the juxtaposed cassette modules. Each of the rods 76, 78 is formed from two telescoping sections 76a, b, 78a, b. The rods are made adjustable so that display frame 52 may be adjustable to accommodate differing numbers of cassette modules. A cassette module 50 is mounted in display frame 52 by first placing the upper opening 56 to enclose the upper rod 76 while the cassette module is pivoted in the forward direction as shown in FIG. 6. The cassette module is then pivoted rearward to align the lower openings 60 with the lower rods 78 and the cassette module lowered so that the lower openings enclose and rest on the lower rods. Upper opening 56 is longer than the lower openings 60 and is located intermediate the spaced lower openings to permit pivoting of the cassette module and to permit the lower rods and openings to be aligned while the upper rod is engaged in the upper opening. The lower rods are spaced from the bottom of the base 80 and the lower openings sized so that the cassette modules rest on the rods.

To permit positive finger grip on the cassette modules for removal from the cassette display without disturbing adjacent cassette modules, a deep recess 81 (FIGS. 7 and 7A) is provided at the bottom front corner of each module. This recess is not visible from the front surface of the cassette module.

The cassette modules are inserted in the frame as described and the cassette display 54 is formed having individually removable cassette modules. The chamber heights and widths may vary from cassette module to cassette module, as described, and a particular cassette display may be assembled having a desired combination of chamber sizes. The frame with the cassette modules mounted therein (FIG. 5) is self-standing and may advantageously be utilized on counters.

Spools may be easily loaded through the front or rear of the cassette modules 50. Front loading is accomplished by pivoting the cassette module to the pivoted position shown in FIG. 6 and depositing the spools in the chambers through the front openings. When loading from a carton as shown in FIG. 2, the spools will roll from the carton and into and along the chamber without individual handling of the spools. Spools may be loaded through the rear openings and top opening by depositing the spools in the opening, pivoting of the module is not required.

Figure 8:
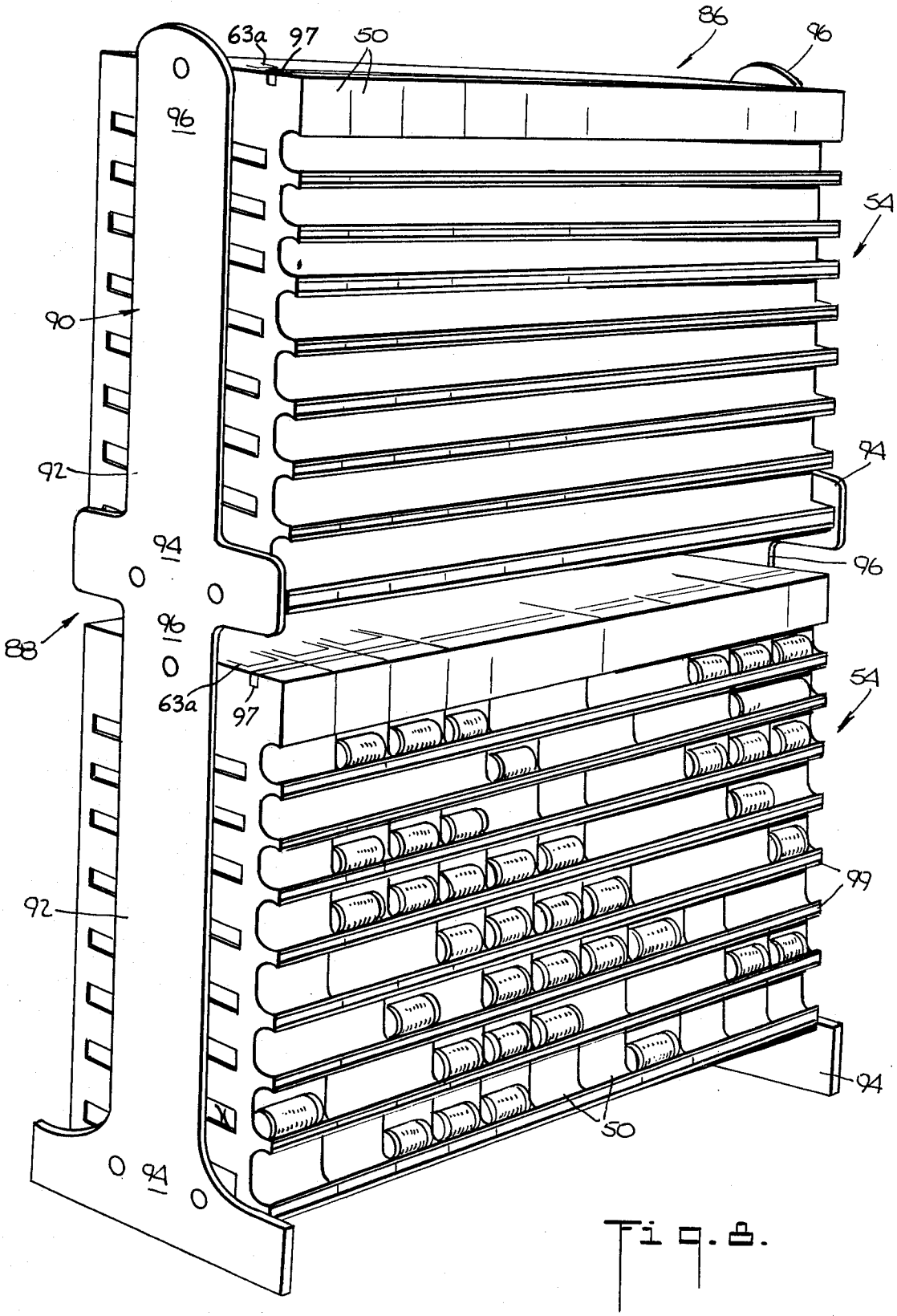
FIG. 8 is a perspective view of two vertically stacked multiple cassette module groups of the type shown in FIG. 5 mounted on a duplex frame similar to the one shown in FIG. 5.

Cassette modules 50 and cassette displays or groups 54 formed therewith may be stacked to form the composite cassette display 86 shown in FIG. 8. Frame 88 comprises duplex plates 90, each being formed from sub-plates 92, of inverted T-shape (or rectangular) similar to plates 72, connected by rods similar to those in frame 52. The bases 94 and tops 96 of the superposed sub-plates are connected to form duplex plates 90. The T-shaped sub-plates may be of different size to accommodate different sized cassette modules and a composite cassette display may be assembled which may house a variety of spool sizes. The composite cassette display of FIG. 8 is self-standing and may be used on the floor as well as on a counter.

A molded notch 97 is provided in the top of each cassette module to hold a display sign 98 (FIG. 9) which also serves to lock the cassette modules together in the display position to prevent tampering.

Color, number and name slots 99 (FIGS. 5–9) are provided on the front and rear of each chamber to identify the particular threads displayed therein and to facilitate easy identification from either side of the cassette module in the course of loading or reloading the chambers.

Figure 9:
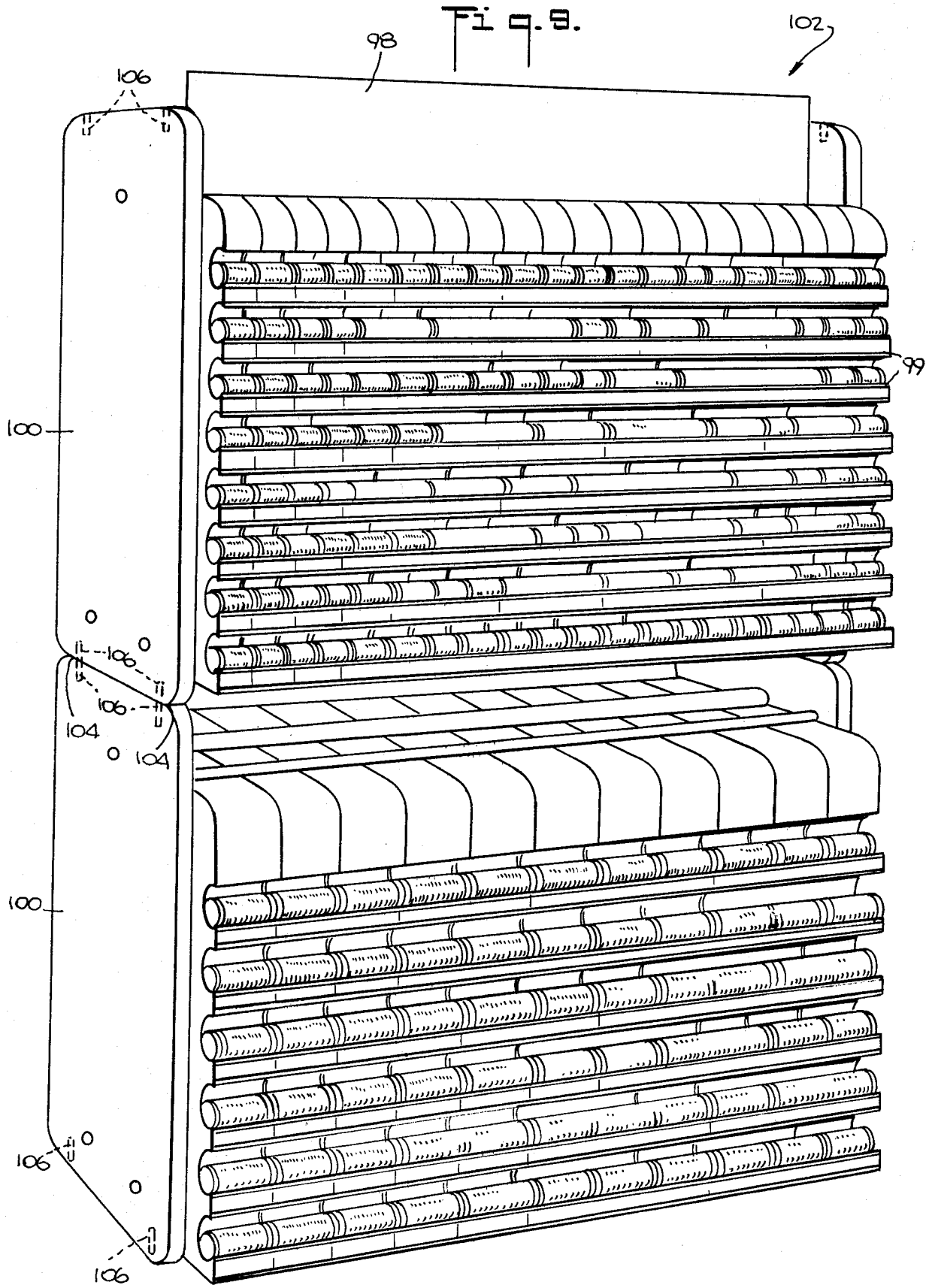
FIG. 9 is a perspective view of two vertically stacked multiple cassette module groups of the type shown in FIG. 5 in which the frames are stacked and interlocked.

Referring now to FIG. 9, the supporting end panels 100 for the cassette display 102 are rectangular with radiused corners. The supporting panels are fitted with an interlocking fastener at the top and bottom near the beginning of the curved corner so that the cassette displays can be securely stacked and interlocked to form multiple level cassette display units. The interlocking fasteners are of the male/female type and comprise pegs 104 and holes 106. The panels are secured by rods as described above.

The advantages of the present invention as well as certain changes and modifications of the disclosed embodiments thereof, will be readily apparent to those skilled in the art. It is the applicant's intention to cover by his claims all those changes and modifications which could be made to the embodiments of the invention herein chosen for the purposes of the disclosure without departing from the spirit and scope of the invention. Protection by Letters Patent of this invention in all its aspects as the same are set forth in the appended claims is sought to the broadest extent that the prior art allows.

What is claimed is:

1. A modular cassette display for tubular articles such as spools of thread comprising a plurality of juxtaposed cassette modules, each of said cassette modules having a top, a bottom, a front and a rear and a plurality of superposed chambers each for housing a plurality of said articles, each of said chambers including a supporting surface for the articles inclined downwardly towards said front of said cassette module, an opening for each of said chambers at least in said front sized to permit passage of the articles therethrough, each of said openings to said chambers in said front extending along opposed sides of a respective cassette module, and an approximately vertically-extending surface disposed adjacent to said opening for retaining the articles thereat, said surface extending for substantially the width of said opening, said display including means for removably juxtaposing said cassette modules to form said cassette display, said means for juxtaposing comprising a single opening centrally located in the top of each of said cassette modules and two openings located in the bottom of each of said cassette modules oppositely spaced from the central part thereof, respective openings being aligned along the tops and bottoms of juxtaposed cassette modules to form series of openings along the tops and bottoms of the juxtaposed cassette modules, a rod extending through each series of aligned openings, and elongated members disposed at exterior sides of exterior cassette modules for preventing movement of the cassette modules therepast, respective members being connected to the ends of respective rods extending through the respective openings, said elongated members extending substantially flush with exterior sides of exterior modules, the openings in the tops of the modules being vertically elongated to provide a space below the rod extending therethrough whereby each of the said cassette modules may be raised vertically a sufficient distance to space the openings in the bottom of the cassette modules from the rods extending therethrough and to permit pivoting of individual cassette modules about the rod extending through the openings in the tops thereof.

2. The cassette display recited in claim 1 wherein, said supporting surface is linear.

3. The cassette display recited in claim 1, wherein each of said cassette modules comprises two mirror-image halves, each module half being made of molded plastic.

4. The cassette display recited in claim 1, wherein there is disposed in each of said openings means defining an entrance to each of said chambers which is larger in cross-sectional area than the cross-sectional area of the interior of the chambers.

5. The cassette display recited in claim 4, wherein said means defining an entrance comprises a first inclined linear surface extending upwardly from the top of the chamber towards said front end of said cassette module.

6. The cassette display recited in claim 5, wherein said first surface terminates short of said front of said cassette module and wherein said means defining an entrance further comprises a second linear surface extending parallel to said supporting surface from said front to said first inclined surface.

7. The cassette display recited in claim 4, and comprising opposed channel means disposed on said vertically-extending surfaces of each cassette module for receiving and retaining inserts therebetween.

8. The cassette display recited in claim 1, wherein each of said cassette modules is identical.

9. The cassette display recited in claim 1, wherein at least two of said cassette modules differ in width such that a plurality of stock keeping units may be accommodated.

10. The cassette display recited in claim 1 and further comprising in each of said cassette modules openings for said chambers in said rear sized to permit passage of articles therethrough.

11. The cassette display recited in claim 10, wherein said cassette modules include a vertically-extending surface disposed adjacent to each opening in the rear of the module.

12. The cassette display recited in claim 1 and comprising an elongated opening in the top of the display adapted to receive a display sign, each of said cassette modules having an opening in the top thereof, the openings in the tops of the cassette modules being aligned to form said elongated opening.

13. The cassette display recited in claim 1, wherein said means for juxtaposing comprise a single opening centrally located in the top of each of said cassette modules and two openings located in the bottom of each of said cassette modules oppositely spaced from the central part thereof, said means for preventing movement comprising an elongated member disposed at each exterior side of each exterior cassette module, each member being connected to the ends of the rods at the respective exterior side, the interconnected rods and members forming a self-standing frame.

14. A cassette module for housing tubular articles such as spools of thread, said cassette module having a top, a bottom, a front and a rear and a plurality of superposed chambers each for housing a plurality of said articles, each of said chambers including a supporting surface for the articles inclined downwardly towards said front of said cassette module, an opening for each of said chambers at least in said front sized to permit passage of the articles therethrough, each of said openings to said chambers extending along opposed sides of the cassette module, and an approximately vertically-extending surface disposed adjacent to said opening for retaining articles thereat, said surface extending for substantially the width of said opening, said cassette module being adapted to be removably juxtaposed with similar modules in a cassette display, means for removably juxtaposing the cassette modules to form the cassette display comprising at least one opening centrally provided in the top of said cassette module and two openings provided in the bottom of said cassette module oppositely spaced from the central part thereof, respective openings of juxtaposed cassette modules being adapted to being aligned along the tops and bottoms of the juxtaposed cassette modules to form series of openings, each series of aligned openings being adapted to receive a rod extending therethrough, the opening in the top of said cassette module being elongated to provide a space below the rod adapted to extend therethrough whereby said cassette module may be raised vertically a sufficient distance to separate the openings in the bottom of the cassette module from the rods adapted to extend therethrough and to permit pivoting the cassette module about the rod adapted to extend through the opening in the top of the cassette module.

15. The cassette module recited in claim 14, wherein said supporting surface is linear.

16. The cassette module recited in claim 14, wherein there is disposed in each of said openings means defining an entrance to each of said chambers which is larger in cross-sectional area than the cross-sectional area of the interior of the chambers.

17. The cassette module recited in claim 16, wherein said means defining an entrance comprises a first inclined linear surface extending upwardly from the top of the chamber towards said front of said cassette module.

18. The cassette module recited in claim 17, wherein said first inclined surface terminates short of said front and wherein said means defining an entrance comprises a second linear surface extending parallel to said supporting surface from said front to said first inclined surface.

19. The cassette module recited in claim 14 and further comprising openings to said chambers disposed in said rear of said cassette module, each said opening in said rear being sized to permit passage of the articles therethrough.

20. The cassette module recited in claim 19 and including a vertically-extending surface disposed adjacent to each opening in the rear of the module.

21. The cassette module recited in claim 14 and further comprising an opening disposed in the top of said module to an uppermost chamber, said opening being sized to permit passage of articles therethrough.

22. The cassette module recited in claim 14, and comprising an opening in the top thereof, wherein upon juxtaposing of the cassette modules each opening is adapted to be aligned to form an elongated opening which is adapted to receive a display sign.

23. The cassette module recited in claim 14 and comprising opposed channel means disposed on said vertically-extending surfaces for receiving and retaining inserts therebetween.

24. A modular cassette display for tubular articles such as spools of thread comprising a plurality of juxtaposed cassette modules, each cassette module including a plurality of superposed chambers each for housing a plurality of articles and means for removably mounting the cassette modules to form the display, said means comprising an opening at the top of each cassette module and at least one opening at the bottom of each cassette module, respective openings being aligned along the tops and bottoms of juxtaposed cassette modules to form series of openings along the tops and bottoms of the juxtaposed cassette modules, a rod extending through each series of aligned openings and means connected to the ends of each rod for preventing movement of the cassette modules therepast, the opening at the top of each cassette module being vertically elongated to provide space therein to permit each cassette module to be raised vertically a sufficient distance to space each opening in the bottom of a raised cassette module from the rod extending therethrough and to permit pivoting of individual cassette modules about the rod extending through the opening at the top thereof.

25. The cassette display recited in claim 24, wherein the vertically-elongated opening is centrally located in the top of each of said cassette modules and two openings are located in the bottom of each of said cassette modules oppositely spaced from the central part thereof, said means for preventing movement comprising elongated members connected at opposed ends of the rods.

26. A cassette module for housing tubular articles such as spools of thread, said cassette module having a plurality of superposed chambers each for housing a plurality of articles, a top and a bottom, said cassette module being adapted to being removably mounted in a cassette display and including means for removably mounting said cassette module in juxtaposition with similar modules in a cassette display, said means comprising an opening at the top of said cassette module and at least one opening at the bottom of said cassette module, respective openings of cassette modules when juxtaposed being adapted to being aligned along the tops and bottoms of the juxtaposed cassette modules to form series of openings, each series of aligned openings being adapted to receive a rod extending therethrough, said opening at the top of said cassette module being vertically elongated to provide a space therein to permit said cassette module when mounted in said display to be raised vertically a sufficient distance to separate each at the bottom of a raised cassette module from the rod adapted to extend therethrough and to permit pivoting of the cassette module about the rod adapted to extend through the opening in the top of the cassette module.

27. The cassette module recited in claim 26, wherein the vertically-elongated opening is centrally provided in the top of said cassette module and two openings are provided in the bottom of the cassette module oppositely spaced from the central part thereof.

* * * * *

UNITED STATES PATENT AND TRADEMARK OFFICE

CERTIFICATE OF CORRECTION

PATENT NO. : 4,243,145

DATED : January 6, 1981

INVENTOR(S) : Robert G. Woodhead

It is certified that error appears in the above—identified patent and that said Letters Patent is hereby corrected as shown below:

Col. 4, line 61 "jointed" should be --joined--.

Signed and Sealed this

*Seventh* Day of *April 1981*

[SEAL]

*Attest:*

RENE D. TEGTMEYER

*Attesting Officer*

*Acting Commissioner of Patents and Trademarks*